US006830031B2

(12) United States Patent
Sans

(10) Patent No.: US 6,830,031 B2
(45) Date of Patent: Dec. 14, 2004

(54) METHOD AND DEVICE FOR CONTROLLING A VEHICLE ENGINE

(75) Inventor: Mariano Sans, Blagnac (FR)

(73) Assignee: Siemens VDO Automotive, Toulouse Cedex (FR)

( * ) Notice: Subject to any disclaimer, the term of this patent is extended or adjusted under 35 U.S.C. 154(b) by 52 days.

(21) Appl. No.: 10/419,221

(22) Filed: Apr. 21, 2003

(65) Prior Publication Data

US 2004/0011328 A1 Jan. 22, 2004

(30) Foreign Application Priority Data

Apr. 22, 2002 (FR) ..... 0204973

(51) Int. Cl.[7] ..... F02D 41/02
(52) U.S. Cl. ..... 123/352; 123/361
(58) Field of Search ..... 123/350, 352–355, 123/361, 399; 180/179; 701/54, 110; 477/110, 111

(56) References Cited

U.S. PATENT DOCUMENTS 4,671,235 A 6/1987 Hosaka ..... 123/352
4,691,677 A * 9/1987 Hotate et al. ..... 123/361
5,921,219 A 7/1999 Frohlich et al. ..... 123/399
6,042,505 A 3/2000 Bellinger ..... 477/111
6,098,592 A 8/2000 Hess et al. ..... 123/350
6,223,721 B1 * 5/2001 Bauer et al. ..... 123/399
6,347,680 B1 2/2002 Mianzo et al. ..... 180/197

FOREIGN PATENT DOCUMENTS

DE 100 46 447 3/2002
FR 2 739 660 4/1997

* cited by examiner

*Primary Examiner*—Tony M. Argenbright
(74) *Attorney, Agent, or Firm*—Young & Thompson

(57) ABSTRACT

A method and device for controlling the engine of a vehicle comprising an accelerator pedal and an engine speed control circuit comprising in particular:

a circuit for closed-loop control of the engine speed, a circuit for interpreting the position of the accelerator pedal, which supplies an engine speed setpoint to the circuit for closed-loop control of the engine speed depending on the position of the accelerator pedal, a circuit for estimating loads external to the vehicle, a circuit for estimating maximum speed likely to be reached by the engine as a function of the estimate of external loads and this maximum speed is supplied by the circuit for interpreting the position of the accelerator pedal and makes the engine speed setpoint very independently of the position of the accelerator pedal.

7 Claims, 2 Drawing Sheets

METHOD AND DEVICE FOR CONTROLLING A VEHICLE ENGINE

FIELD OF THE INVENTION

The present invention relates to a method and a device for controlling a vehicle engine.

BACKGROUND OF THE INVENTION

To control a vehicle engine, it is known to use an accelerator pedal mechanically connected to the butterfly of a carburetor in order to influence the flow of air entering the engine. For various reasons, especially associated with fuel savings, these mechanical controls have been replaced with electrical controls by means of which the position of the accelerator pedal is sensed and serves to influence an electric motor which acts on the air intake butterfly of the carburetor. In both cases, the driver directly controls the flow of air entering the engine and, consequently, the engine torque.

In more sophisticated versions, various engine operating parameters, for example ignition advance and injection, are controlled by means of a torque setpoint which corresponds to the position of the accelerator pedal. In such a device, the position of the accelerator pedal is interpreted by an electronic device in order to supply a torque setpoint value which, according to a theoretical model, allows the engine torque to be controlled.

It has been observed that there is no direct torque sensor on commercial vehicles, so that the torque is necessarily controlled in "open loop", that is to say without verification of the value actually obtained, but by indirectly estimating, especially as a function of the flow of air consumed, the air pressure in the intake manifold or the air/fuel ratio used. Because of the imperfection of the theoretical model and of the resistive torques (error of +/− 10%), such a device may cause annoyances when driving, saturations or diversity of response.

SUMMARY OF THE INVENTION

The present invention aims to overcome these drawbacks. To this end, the present invention provides a device for controlling the engine of a vehicle comprising an accelerator pedal and an engine speed control circuit comprising in particular:

- a circuit for closed-loop control of the engine speed,
- a circuit for interpreting the position of the accelerator pedal, which supplies an engine speed setpoint to the circuit for closed-loop control of the engine speed depending on the position of the accelerator pedal,
- a circuit for estimating loads external to the vehicle, characterized in that it is provided with a circuit for estimating maximum speed which gives a maximum engine speed likely to be reached by the engine as a function of the estimate of external loads supplied by the circuit for estimating external loads and in that this maximum speed is supplied to the circuit for interpreting the position of the accelerator pedal and makes the engine speed setpoint vary independently of the position of the accelerator pedal, so as to reproduce some of the sensations usually felt by the driver when the engine is torque controlled.

By means of these provisions, the engine is controlled by speed and not by torque, which makes it possible to take into account accurate measurements of the speed, to overcome the effects of at least some of the resistive torques and to optimize the transients. Since the engine speed can be easily measured, the closed loop control can be accurate, robust and carried out with simple algorithms. Furthermore, the circuit for interpreting the position of the accelerator pedal modifies the speed setpoint to take into account the variations of loads external to the vehicle.

According to particular features, the speed setpoint is modified by taking the value of the maximum engine speed delivered by the circuit for estimating maximum speed as a maximum limit of the setpoint speed in the circuit for interpreting the position of the accelerator pedal. Using these provisions, the driver may feel the usual driving sensations. For example, when the vehicle approaches a hill, the speed setpoint decreases and gives the sensation that the resistive torque due to the hill causes a variation in the stabilized speed.

According to particular features, the device as briefly mentioned above comprises a circuit for generating auxiliary loads which supplies a signal representative of predetermined resistive loads internal to the vehicle, the circuit for interpreting the position of the accelerator pedal not altering the setpoint speed for said predetermined auxiliary loads. By virtue of these provisions, the driver avoids the driving annoyances which are usually felt when the loads internal to the vehicle vary, for example when an air conditioner starts to operate.

According to particular features, the device as briefly mentioned above comprises a means for switching between an economical driving mode and a sporting driving mode, the dynamics of converging toward a setpoint engine speed being different for said driving modes. By means of these provisions, the vehicle manufacturer or driver may select a behavior "mood" for the vehicle.

According to particular features, the device as briefly mentioned above comprises a weighting means for weighting between an operating mode with modification of the engine speed setpoint as a function of external loads by the circuit for interpreting engine speed setpoint and an operating mode without this modification. By means of these provisions, the driver may choose whether or not the engine speed of his vehicle changes as a function of the slope of the road on which he is moving.

The present invention also provides a method of controlling the engine of a vehicle comprising an accelerator pedal and an engine speed control circuit comprising:

- a step a) of detecting the position of the accelerator pedal,
- a step b) of estimating loads external to the vehicle,
- a step c) of interpreting the position of the accelerator pedal during which said position is associated with an engine speed setpoint,
- a step d) of closed-loop control of the engine speed according to the speed setpoint established in step c), characterized in that it comprises, between step b) and step c)

- a step b1) of estimating a maximum speed likely to be reached by the engine as a function of the external loads estimated in step b)

and in that the engine speed setpoint established in step c) is modified, independently of the position of the accelerator pedal, by the maximum speed likely to be reached by the engine, determined in step b1), so as to reproduce some of the sensations usually felt by the driver when the engine is torque controlled.

BRIEF DESCRIPTION OF THE DRAWINGS

Other advantages, aims and features of the present invention will become apparent from the following description, made with respect to the appended drawings in which.

DETAILED DESCRIPTION OF THE INVENTION

Figure 1:
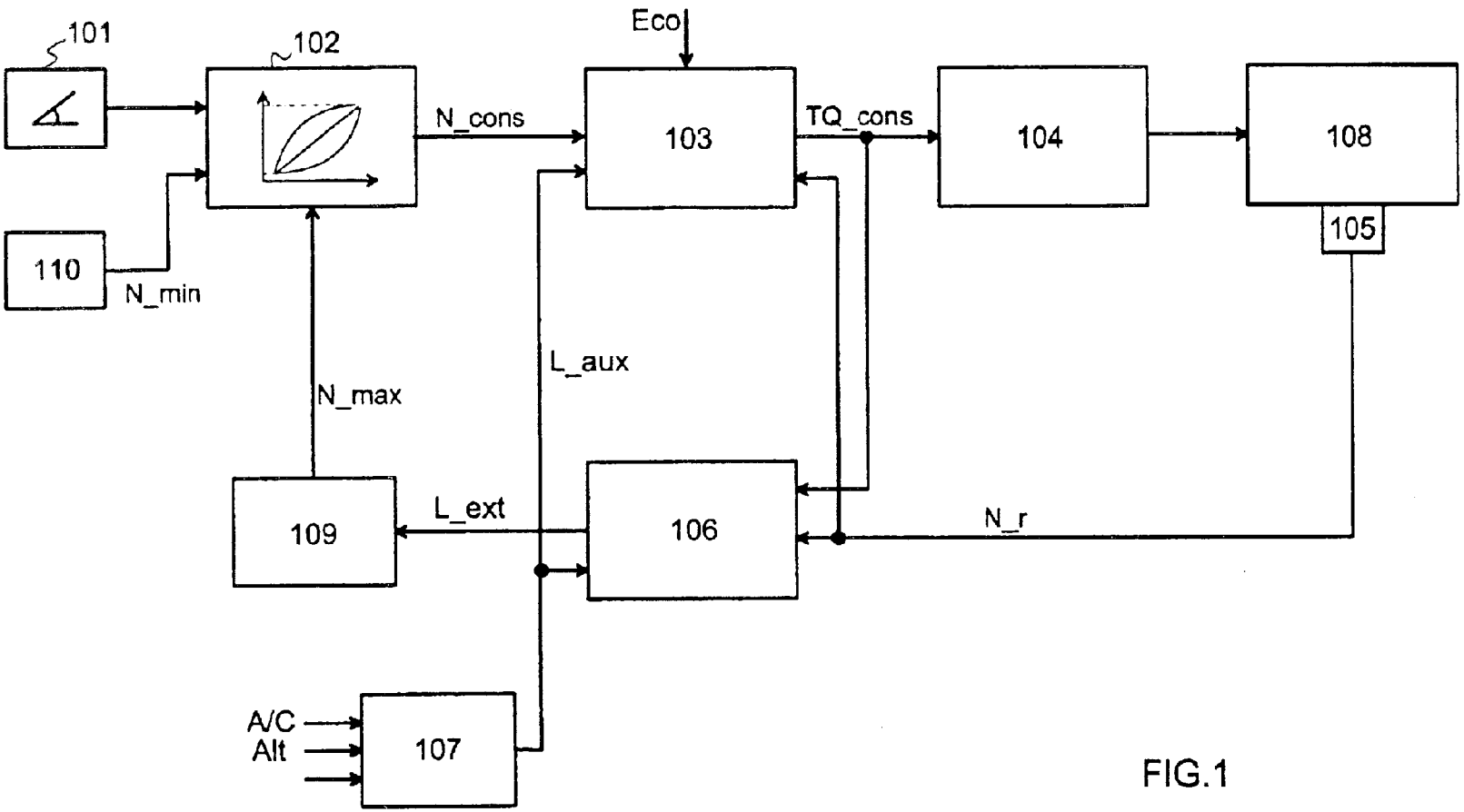
FIG. 1 shows schematically a particular embodiment of the device which is the subject of the present invention.

FIG. 1 shows an accelerator pedal 101 signal generator, which supplies a signal representative of the position of the accelerator pedal (not shown) to a circuit 102 for interpreting engine speed setpoint which supplies an engine speed setpoint signal N_cons to a closed-loop engine speed controller 103. The engine speed controller 103 supplies an engine torque setpoint TQ_cons to the control unit 104 which influences the engine actuators 108 of the vehicle. An engine speed sensor 105 supplies a signal representative of the effective speed N_r of the engine 108, on the one hand, to the engine speed controller 103 and, on the other hand, to a circuit 106 for estimating external loads.

A circuit 107 for generating an auxiliary load signal supplies a signal L_aux representative of the auxiliary loads (for example due to the operation of an air conditioner) to the engine speed controller 103 and to the circuit 106 for estimating external loads.

The circuit 106 for estimating external loads (see FIG. 2) supplies a signal L_ext representative of the external loads to a circuit 109 for estimating maximum engine speed which supplies, to the circuit 102 for interpreting engine speed setpoint, a signal N_max representative of the maximum engine speed that the engine can reach as a function of the external loads which prevail at a given moment.

A minimum speed generator 110 supplies, to the circuit 102 for interpreting engine speed setpoint, a signal N_min representative of the minimum operating speed of the engine 108, generally called "idle". The minimum speed may be variable, for example as a function of the temperature of the engine 108.

The accelerator pedal 101 signal generator receives, as an input, the mechanical position of the accelerator pedal and supplies a signal representative of the position of the accelerator pedal, according to known techniques which are not detailed here.

The circuit 102 for interpreting engine speed setpoint receives, as input, several signals:

- the signal supplied by the accelerator pedal 101 signal generator,
- the signal N_min supplied by the minimum speed generator 110,
- the signal N_max supplied by the circuit 109 for estimating maximum engine speed, and
- optionally, a signal representative of the gear selected (not shown).

It provides an engine speed setpoint signal as a function of these input signals. In a linear model, for example, the engine speed corresponding to the engine speed setpoint is equal to the sum of the minimum engine speed and of the product, of the difference between the maximum engine speed and the minimum engine speed and of the accelerator pedal position signal, normalized to equal "0" when the accelerator pedal is released and "1" when it is at the end of travel. In other models, the engine speed corresponding to the engine speed setpoint is a one-to-one function of the accelerator pedal position signal, the graph of which may be plotted as a function of the "mood" that it is desired to give to the vehicle.

The closed-loop engine speed controller 103 receives, as input, several signals:

- the engine speed setpoint signal N_cons coming from the circuit 102 for interpreting engine speed setpoint,
- the signal L_aux representative of auxiliary loads coming from the circuit 107 for generating auxiliary load signal, and
- the signal N_r representative of the effective engine speed coming from an engine speed sensor 105.

The engine speed controller 103 supplies an engine torque setpoint TQ_cons to the control unit 104 as a function of these input signals. By way of example of constraints on said function:

- the greater the difference between the effective engine speed and the engine speed setpoint signal, the greater the torque setpoint,
- as a variant, the greater the auxiliary loads, the greater the torque setpoint.

The engine speed controller 103 may also receive additional information (Eco) making it possible to switch between an economical driving mode and an aggressive driving mode, the dynamics of converging toward the speed setpoint being different for said driving modes. For example, it is possible to play with the response time of the speed control, or else, for equivalent response time, with the shape of the speed variation. The function of closed-loop control of the engine speed controller 103 is thus either economical in terms of energy, in order to optimize the transients, or has higher energy consumption in order to obtain a more responsive engine. Of course, this switching may also be gradual, thus allowing a whole range of intermediate behaviors.

Figure 2:
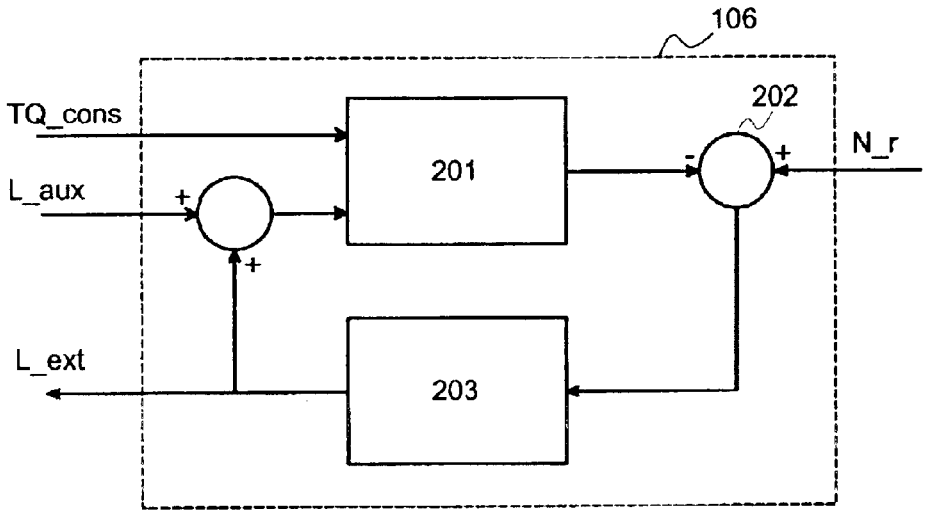
FIG. 2 shows a circuit for estimating loads, or resistive torques, external to the vehicle, of the device illustrated in FIG. 1.

The circuit 107 for generating auxiliary load signal monitors at least some of the vehicle loads which consume enough energy to affect the engine speed, in particular the air conditioning (A/C), and supplies a signal representative of the sum of the auxiliary loads supported by the engine. The auxiliary loads are predetermined according to vehicle type and its equipment and accessories: a list of consumers of known torque (air conditioning, window opening, etc.) where it is possible to monitor them being brought into action, is defined for this purpose. According to one particular embodiment, the circuit 107 for generating auxiliary load signal is connected to the alternator (Alt) of the vehicle engine 108. The other resistive torques, such as those associated with the slope of the road, with the wind or with a hitched load, for example, are considered as external or unknown loads and are evaluated by the circuit 106 for estimating external loads, which is constructed as illustrated in FIG. 2. It comprises an engine speed modeling circuit 201, a comparator 202 for comparing the theoretical speed determined by the modeling circuit 201 with the speed measured by the speed sensor 105 and a circuit 203 for estimating unknown loads.

The speed modeling circuit 201 receives, as an input, on the one hand, the engine torque setpoint TQ_cons coming from the engine speed controller 103 and, on the other hand, the sum of the signal L_aux representative of the auxiliary loads supported by the engine, coming from the circuit 107 for generating auxiliary load signal and of the signal L_ext representative of the external loads coming from the circuit for estimating unknown loads 203. The speed modeling circuit 201 supplies, as output, a theoretical speed that the engine should reach as a function of the input signals. For example, the speed modeling circuit 201 may consist of a model of the moments of inertia of the engine and of the vehicle or else comprise a table of the speed values as a function of the setpoint torque and of the applied loads established by prior bench tests.

The circuit 203 for estimating unknown loads iteratively determines a calculation of the external loads as a function of the difference between the theoretical speed and the actual speed, for example by integrating this difference multiplied by a constant factor.

On observing FIG. 2, it will be understood that the circuit 106 for estimating external loads supplies a signal representative of the external loads which takes into account the engine torque setpoint coming from the closed-loop engine speed controller 103, the auxiliary load signal coming from the auxiliary load signal generation circuit 107, and the effective speed of the engine 108, supplied by the engine speed sensor 105, taking account of the vehicle's inertia.

In the particular embodiment illustrated in FIG. 1, the circuit 109 for estimating maximum engine speed receives, as input, the signal from the circuit 106 for estimating external loads and supplies a signal N_max representative of the maximum engine speed that the engine can reach as a function of the external loads which are applied to the vehicle at the instant in question. This circuit may be produced, for example, by means of a table of maximum speed values obtained on the test bench in the presence of a variable applied load. This table may also comprise particular values, for example in the case where the external loads would be negative (such as a steep downhill or a strong following wind), in order to level off or even reduce the value of N_max. The circuit 109 for estimating maximum engine speed may also comprise a weighting means (not shown) making it possible to take into account, when determining the maximum speed, only a portion of the external loads. Note that the circuit for estimating maximum engine speed does not directly take into account auxiliary loads.

The signal N_max representative of the maximum engine speed is thus supplied to the circuit 102 for interpreting engine speed setpoint. Thus, in the latter, the maximum limit of the setpoint speed is representative of the maximum speed that the engine can reach under the current conditions. As a result, the interpretation of the position of the accelerator pedal, and therefore the setpoint speed N_cons will be representative of the external load conditions to which the vehicle is subjected and makes it possible to provide the sensations usually felt by the drivers when the engine is torque controlled, as in the prior art of the present invention (a hill causes a decrease in the speed setpoint in order to reproduce the usual sensation according to which, for the same accelerator pedal position, a hill causes the engine speed to reduce). In this particular embodiment, the driving sensations of the drivers are retained by using modifying factors which correspond to the torques due to the changes in environment of the vehicle, for example hill, downhill or violent wind. As was seen above, the weighting means included in the circuit 109 for estimating maximum engine speed makes it possible to vary the intensity of these sensations as a function of the external loads taken into account.

Of course, the device described above in a functional manner may be produced physically by any means known to a person skilled in the art. However, it will advantageously be incorporated into an engine control computer comprising at least a microprocessor, its associated memories being suitable for containing the aforementioned tables and program instructions, the functions of the various circuits being implemented by suitable subprograms.

What is claimed is:

1. A device for controlling the engine (108) of a vehicle comprising an accelerator pedal (101) and an engine speed control circuit (102, 103, 106, 109) comprising in particular:

a circuit (103) for closed-loop control of the engine speed, a circuit (102) for interpreting the position of the accelerator pedal, which supplies an engine speed setpoint to the circuit (103) for closed-loop control of the engine speed depending on the position of the accelerator pedal (101), a circuit (106) for estimating loads external to the vehicle, characterized in that it is provided with a circuit (109) for estimating maximum speed which gives a maximum engine speed likely to be reached by the engine as a function of the estimate of external loads supplied by the circuit (106) for estimating external loads and in that this maximum speed is supplied to the circuit (102) for interpreting the position of the accelerator pedal and makes the engine speed setpoint vary independently of the position of the accelerator pedal (101), so as to reproduce some of the sensations usually felt by the driver when the engine is torque controlled.

2. The device as claimed in claim 1, characterized in that the speed setpoint is modified by taking the value of the maximum engine speed delivered by the circuit (109) for estimating maximum speed as a maximum limit of the setpoint speed in the circuit (102) for interpreting the position of the accelerator pedal.

3. The device as claimed in claim 1, characterized in that it comprises a circuit (107) for generating auxiliary loads which supplies a signal representative of predetermined resistive loads internal to the vehicle, the circuit (102) for interpreting the position of the accelerator pedal not altering the setpoint speed for said predetermined loads.

4. The device as claimed in claims 1, characterized in that the circuit (109) for estimating maximum engine speed further comprises a weighting means for weighting between an operating mode with modification of the engine speed setpoint as a function of external loads by the circuit (102) for interpreting engine speed setpoint and an operating mode without this modification.

5. The device as claimed in claims 1, characterized in that it comprises a means (Eco) for switching between an economical driving mode and a sporting driving mode, the dynamics of converging toward the speed setpoint being different for said driving modes.

6. A method of controlling the engine (108) of a vehicle comprising an accelerator pedal (101) and an engine speed control circuit (102, 103, 106, 109) comprising:

a step a) of detecting the position of the accelerator pedal (101), a step b) of estimating loads external to the vehicle, a step c) of interpreting the position of the accelerator pedal during which said position is associated with an engine speed setpoint, a step d) of closed-loop control of the engine speed according to the speed setpoint established in step c), characterized in that it comprises, between step b) and step c)

a step b1) of estimating a maximum speed likely to be reached by the engine as a function of the external loads estimated in step b)

and in that the engine speed setpoint established in step c) is modified, independently of the position of the accelerator pedal (101), by the maximum speed likely to be reached by the engine, determined in step b1), so as to reproduce some of the sensations usually felt by the driver when the engine is torque controlled.

7. The method as claimed in claim 6, characterized in that the speed setpoint is modified by taking the value of the maximum engine speed delivered by the circuit (109) for estimating maximum speed as a maximum limit of the setpoint speed in the circuit (102) for interpreting the position of the accelerator pedal.

* * * * *